US006692906B1

(12) United States Patent
Lelental et al.

(10) Patent No.: US 6,692,906 B1
(45) Date of Patent: Feb. 17, 2004

(54) SILVER-(CARBOXYLATE-AZINE TONER) PARTICLES FOR PHOTOTHEMOGRAPHIC AND THERMOGRAPHIC IMAGING

(75) Inventors: Mark Lelental, Rochester, NY (US); Peter J. Ghyzel, Rochester, NY (US); John W. Boettcher, Webster, NY (US); James L. Wakley, Brockport, NY (US); David A. Dickinson, Brockport, NY (US); Joe E. Maskasky, Rochester, NY (US); Roger L. Klaus, Victor, NY (US); Victor P. Scaccia, Rochester, NY (US); Thomas Blanton, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 25 days.

(21) Appl. No.: 10/200,426

(22) Filed: Jul. 22, 2002

(51) Int. Cl.[7] ..... G03C 1/498

(52) U.S. Cl. ..... 430/619; 430/620; 430/631; 430/964; 430/965

(58) Field of Search ..... 430/619, 620, 430/631, 965, 622, 964

(56) References Cited

U.S. PATENT DOCUMENTS

| | | | | |
|---|---|---|---|---|
| 3,666,477 | A | 5/1972 | Goffe | |
| 5,350,669 | A | 9/1994 | Whitcomb et al. | |
| 6,391,537 | B2 * | 5/2002 | Lelental et al. | 430/620 |

FOREIGN PATENT DOCUMENTS

| | | |
|---|---|---|
| EP | 0803764 A1 | 4/1997 |

* cited by examiner

*Primary Examiner*—Thorl Chea
(74) *Attorney, Agent, or Firm*—J. Jeffrey Hawley

(57) ABSTRACT

The present disclosure relates to aqueous dispersions of silver (carboxylate-azine toner) particles wherein the azine content of the particles is from about 0.01 to 10% by weight relative to silver carboxylate. The carboxylates are typically silver salts of long chain fatty acids and the azine toners are the compounds that function as development accelerators and toning agents such as phthalazine. These silver (carboxylate-azine) particles can be used to formulate imaging forming compositions that are useful in aqueous thermographic or photothermographic imaging elements.

8 Claims, No Drawings

SILVER-(CARBOXYLATE-AZINE TONER) PARTICLES FOR PHOTOTHEMOGRAPHIC AND THERMOGRAPHIC IMAGING

FIELD OF THE INVENTION

This invention relates to aqueous dispersions of silver (carboxylate-azine toner) particles. The carboxylates are typically silver salts of long chain fatty acids and the azine toners are the compounds that function as development accelerators and toning agents. These silver (carboxylate-azine) particles are used to formulate imaging forming compositions that are useful in aqueous photothermographic or thermographic imaging elements. In another aspect, the invention relates to a coprecipitation method for producing the particles.

DESCRIPTION RELATIVE TO THE PRIOR ART

Thermographic and photothermographic materials and imaging elements are well known in the photographic art. These materials are also known as heat developable photographic materials. Thermographic materials can form an image by the imagewise application of heat. Photothermographic materials include a light sensitive material, for example a silver halide. After imagewise exposure photothermographic materials are heated to moderately elevated temperatures to produce a developed image in the absence of separate processing solutions or baths.

An example of a known photothermographic silver halide material comprises (a) a hydrophilic photosensitive silver halide emulsion containing a gelatino peptizer with (b) an organic solvent mixture, (c) a hydrophobic binder and (d) an oxidation-reduction image-forming composition. The oxidation-reduction imaging forming composition typically comprises (i) a silver carboxylate that is usually a silver salt of a long-chain fatty acid, such as silver behenate or silver stearate, in combination with (ii) an organic reducing agent, such as a phenolic reducing agent. It has been desirable to have hydrophilic photosensitive silver halide emulsion containing a gelatino peptizer in such a photothermographic material because of the higher photosensitivity of the silver halide emulsion and the ease of control in preparation of the emulsion based on conventional aqueous silver halide gelatino emulsion technology.

A problem has been encountered in preparing these photothermographic silver halide materials. This problem involves the mixing of a hydrophilic photosensitive silver halide emulsion containing a gelatino peptizer with an oxidation-reduction imaging forming composition. The imaging forming composition contains hydrophobic components including a hydrophobic binder, such as poly(vinyl butyral), and a silver salt of a long-chain fatty acid, such as a silver salt of behenic acid. Typically, when the hydrophilic photosensitive silver halide emulsion is mixed with the hydrophobic imaging forming materials and then coated on a suitable support to produce a photothermographic element, the resulting element produces a less than desired degree of photosensitivity, contrast and maximum density upon exposure and heat processing. This problem has been encountered in photothermographic silver halide materials, as described in, for example, U.S. Pat. No. 3,666,477 of Goffe, issued May 30, 1972. Goffe proposed addition of alkylene oxide polymers and a mercaptotetrazole derivative to the photothermographic material to help provide increased photosensitivity. In addition, a variety of organic solvents have been proposed in order to help prepare a photothermographic silver halide composition containing the described image-forming components. The organic solvents that have been proposed include isopropanol, acetone, toluene, methanol, 2-methoxyethanol, chlorinated solvents, acetone-toluene mixtures and certain non-aqueous polar organic solvents. The described individual solvents, such as isopropanol, have not provided the desired improved properties. There has been a continuing need to provide improved relative speed, contrast and image tone with desired maximum image density.

It is known to provide toners in thermographic and photothermographic compositions to increase chemical reactivity of the development chemistry and to improve the tone of the developed image. The compositions described herein are typically used to produce elements that are useful in x-ray imaging. For diagnostic purposes, doctors prefer neutral images on blue tinted support. The images should have very low minimum density and very high maximum density for optimum diagnostic use. The use of toner compounds can help accomplish these objectives.

A variety of toner compositions are known. For example, in EP 0803764 A1 filed Apr. 16, 1997, there is described a thermographic composition having a succinimide toner incorporated in the composition (See Example 1).

The materials and imaging elements described herein can be used as output media and can be exposed using a laser printer, typically from a digitized x-ray image. Laser printers of interest typically expose the elements to infrared laser radiation, for example in the 800 nm range. Since silver halide is not inherently sensitive to infrared radiation, it must be spectrally sensitized to this wavelength range in order to be effectively exposed.

Recent developments have focused on providing imaging compositions, for example photothermographic compositions, that are aqueous based. Such compositions, compared to organic solvent-based compositions, have numerous coating advantages. For example, expensive organic solvent recovery systems are not necessary in the coating process.

In commonly assigned U.S. Pat. No. 5, 350,669 to Witcomb et al, issued Sep. 27, 1994, there are disclosed compositions comprising silver, carboxylate and azine as the primary non-photosensitive, reducible silver source for a photothermographic element. These compounds contain relatively large amounts of the expensive azine component. The minimum amount of azine disclosed by Witcomb et al is about 14% by weight relative to silver carboxylate. (This assumes the minimum mass associated with the azine structure and a maximum for the carboxylate within the ranges specified.)

We have found that the presence of azine toner compounds significantly impacts the ability to spectrally sensitize a photosensitive silver halide emulsion in an aqueous environment. The inability to maintain sufficient spectral sensitization causes it to be difficult to maintain an adequate maximum density in the processed elements. Succinimide toner does not desensitize infrared sensitized silver halide.

SUMMARY OF THE INVENTION

In one aspect of the invention, there is provided an aqueous dispersion of silver-carboxylate particles having incorporated therein an azine toner compound. The azine content of the silver (carboxylate-azine toner) particles is from about 0.01 to 10% by weight relative to silver carboxylate, preferably about 0.05 to 5%. Other species can also be present, for example about 0.01 to 20% by weight relative to the silver carboxylate can be carboxylic acid, preferably 5 to 15% and about 0.01 to 2% by weight relative to the silver carboxylate can be alkali metal carboxylate salt (for example sodium or potassium carboxylate etc.) preferably 0.5 to 1.5%.

As will be seen in the comparative examples below, these silver (carboxylate-azine toner) particles substantially avoid the desensitization of spectrally sensitized silver halide. While not wishing to be bound by any particular theory, we believe that the desensitization by azine toner compounds in prior compositions can be attributed to the desorption of the spectral sensitizing dye from the surface of the silver halide grains. This in turn may be caused by the presence of the "free" azine toner compound. In the present invention, the azine toner is incorporated into the carboxylate particles and is therefore not "free" to desensitize adjacent silver halide grains. These particles provide the desired silver development kinetics, image density and image tone.

As noted, a characteristic of the present invention is that the silver-carboxylate particles have an azine toner compound incorporated into the structure of the particles. Another aspect of the invention is that the azine is present in a small amount. We have found that this small amount provides the desired development acceleration and image toning. Compositions using such small amounts are cheaper and less likely to produce interference with the spectral sensitizer than are compositions using larger amounts of azine toner. Further, high levels of azine, even if complexed with silver carboxylate, results in higher d-min than desired and less than desired raw stock keeping characteristics. Being incorporated into the particle means that the azine toner is not free but rather is part of the particle in the same sense, for example, as would, be a dopant. One of the characteristics of such a particle is that the x-ray diffraction pattern resembles the pattern obtained from the silver-carboxylate. In contrast, if silver carboxylate particles are simply mixed with silver-azine toner particles, a second novel crystallographic phase is observed in the x-ray diffraction pattern of the mixture. These particles will be referred to as "silver(carboxylate-azine toner) particles".

In preferred embodiments of the invention, the silver (carboxylate-azine toner) particles incorporated into the aqueous composition exhibit nanoparticulate morphology. It is particularly preferred that at least a portion of the non-photosensitive source of reducible silver ions be provided in the form of an aqueous nanoparticulate dispersion of silver (carboxylate-azine toner) particles having the desired content of azine. By nanoparticulate, we mean that the silver (carboxylate-azine toner) particles in such dispersions preferably have a weight average particle size of less than 1000 nm when measured by any useful technique such as sedimentation field flow fractionation, photon correlation spectroscopy, or disk centrifugation. In one particular method of measuring particle size the silver carboxylate and silver (carboxylate-azine toner) particle size and it's distribution is determined using a Horiba LA-920, He—Ne, laser particle size analyzer. This analyzer measures the particle size distribution by angular light scattering technique. Obtaining such small silver (carboxylate-azine toner) particles can be achieved using a variety of techniques described in the copending applications identified in the following paragraphs, but generally they are achieved using high speed milling using a device such as those manufactured by Morehouse-Cowles and Hochmeyer. The details for such milling are well known in the art.

In another aspect of the invention, there is provided an aqueous oxidation-reduction imaging forming composition comprising (i) a dispersion silver (carboxylate-azine toner) particles wherein the azine content of the particles is from about 0.01 to 10% by weight relative to silver carboxylate said particles having on the surface of the particles a surface modifier which is a nonionic oligomeric surfactant based on vinyl polymer with an amido function and (ii) an organic reducing agent. This composition can be coated on a support to provide a useful thermographic element.

In another aspect of the invention, there is provided an aqueous photothermographic composition comprising a) an infrared spectrally sensitized photosensitive silver halide emulsion containing a gelatino peptizer and b) an oxidation-reduction imaging forming composition comprising (i) a dispersion of silver (carboxylate-azine) particles wherein the azine content of the particles is from about 0.01 to 10% by weight relative to silver carboxylate said particles having on the surface of the particles a surface modifier which is a nonionic oligomeric surfactant based on a vinyl polymer with an amido function and (ii) an organic reducing agent. The described photothermographic composition can be coated on a support to provide a useful photothermographic element.

DETAILED DESCRIPTION OF THE INVENTION

This invention solves, or greatly minimizes the prior art desensitization problems referred to above. A process is provided that produces an aqueous silver (carboxylate-azine) particle dispersion. Furthermore, the preferred process of this invention provides aqueous colloidal dispersions containing small particles with narrow particle size distribution. The imaging elements comprising silver (carboxylate-azine) particles exhibit greatly improved photographic properties and superior raw stock keeping characteristics in comparison to the elements formulated by adding "free" azine toner during the preparation of the coating melt. The images produced using photothermographic elements of this invention exhibit low turbidity, high optical density and neutral tone. The potential losses of spectral sensitivity in the extrinsic region of the silver halide photo response e.g. IR, caused by silver halide-sensitizing dye—"free" azine toner interactions, are minimized by the incorporation of the toner in the form of a bound-azine toner compound within the silver (carboxylate-azine) particles. The preferably nanoparticulate, aqueous, silver-carboxylate, silver-azine toner particle dispersions are easy to filter and display excellent shelf life. These dispersions have been successfully incorporated with the other necessary ingredients into an aqueous photothermographic imaging element and successfully exposed and thermally processed using a laser printer and thermal processor.

The particles in such dispersions can be stabilized by having on their surface a surface modifier so the silver salt can more readily be incorporated into aqueous-based photothermographic formulations. Useful surface modifiers include, but are not limited to, nonionic oligomeric surfactants based on vinyl polymers having an amino function, such as polymers prepared from acrylamide, methacrylamide, or derivatives thereof, as described in copending and commonly assigned POLYACRYLAMIDE SURFACE MODIFIERS FOR SILVER CARBOXYLATE NANOPARTICLES, Lelental, Pitt, Dickinson, Wakley and Ghyzel, Published application US 20010031436 A1 Aug. 18, 2001. A particularly useful surface modifier is dodecylthiopolyacrylamide that can be prepared as described in the noted copending application using the teaching provided by Pavia et al., Makromoleculare Chemie, 193(9), 1992, pp. 2505–17.

Other useful surface modifiers are phosphoric acid esters, such as mixtures of mono- and diesters of orthophosphoric acid and hydroxy-terminated, oxyethylated long-chain alcohols or oxyethylated alkyl phenols as described for example in PHOSPHORIC ACID ESTER SURFACE MODIFIERS FOR SILVER CARBOXYLATE NANOPARTICLES, Lelental, Dickinson, Wakley, Orem and Ghyzel, Published application US 20010029001 A1 Aug. 18, 2001. Particularly useful phosphoric acid esters are commercially available from several manufacturers under the trademarks or tradenames EMPHOS™ (Witco Corp.), RHODAFAC (Rhone-Poulenc), T-MULZ® (Hacros Organics), and TRYFAC (Henkel Corp./Emery Group).

Such dispersions contain smaller particles and narrower particle size distributions than dispersions that lack such surface modifiers. Particularly useful nanoparticulate dispersions are those comprising silver carboxylates such as silver salts of long chain fatty acids having from 8 to 30 carbon atoms, including, but not limited to, silver behenate, silver caprate, silver hydroxystearate, silver myristate, silver palmitate, and mixtures thereof. Silver behenate nanoparticulate dispersions are most preferred. These nanoparticulate dispersions can be used in combination with the conventional silver salts described above, including but not limited to, silver benzotriazole, silver imidazole, and silver benzoate. In another aspect of the invention, there is provided an aqueous oxidation-reduction imaging forming composition comprising (i) a dispersion of silver (carboxylate-azine toner) particles as described having on the surface of the particles a surface modifier which is a nonionic oligomeric surfactant based on vinyl polymer with an amido function and (ii) an organic reducing agent.

In the case of controlled coprecipitation of metal salts or complexes such as water insoluble silver (carboxylate-azine) particles, the surface modifiers offer higher degree of particle size reduction, an improved colloidal stability of the dispersed system, higher chemical reactivity and lower low-shear viscosity. The nanoparticulate silver (carboxylate-azine) particles increase the reactivity of the silver metal-forming oxidation-reduction photothermographic development chemistry and hence, a lower temperature and (or) shorter development time is required to generate final silver image and to maximize image discrimination. Furthermore, the use of nanoparticulate silver(carboxylate-azine toner) particles in the film microstructure provides for a significant reduction of the film turbidity generally attributed to the particle size controlled light scattering improved image density and neutral image tone.

The present invention relates to a dispersion of silver (carboxylate-azine toner) particles. Particularly preferred silver-carboxylates are silver salts of long chain fatty acids such as, for example, silver stearate, silver behenate, silver caprate, silver hydroxystearate, silver myristate and silver palmitate. The preferred azine toner compounds are phthalazine and substituted phthalazine.

X-ray diffraction patterns show the described silver (carboxylate-azine toner) is different from a simple mixture of silver-carboxylate and silver-azine toner. Silver (behenate-phthalazine) has an x-ray diffraction pattern that is very similar to silver-behenate while a mixture of silver-behenate and silver phthalazine exhibits an addition phase.

The use of nonsilver (carboxylate-azine toner) toners/development accelerators or derivatives thereof which improve the image density and tone, is highly desirable, to the element. Toners may be present in amounts of from 0.01 to 20 percent by weight of the emulsion layer, preferably from 0.1 to 10 percent by weight. In addition to the toner that is present in the silver (carboxylate-azine toner) particles, additional toner may be present. These other toners can be present to provide enhanced chemical reactivity and to adjust tone as desired. For sensitized materials, toners should be chosen that do not desensitize the spectrally sensitized silver halide. Toners are well known materials in the photothermographic art as shown in U.S. Pat. Nos. 3,080,254; 3,847,612 and 4,123,282. Examples of useful toners include phthalimide and N-hydroxyphthalimide; cyclic imides such as succinimide, pyrazoline-5-ones, and a quinazolinone, 1-phenylurazole, 3-phenyl-2-pyrazoline-5-one, quinazoline and 2,4-thiazo lidinedione; naphthalimides such as N-hydroxy-1,8-naphthalimide; cobalt complexes such as cobaltic hexaminetrifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, e.g. (N,N-dimethylaminomethyl)phthalimide, and N-(dimethylaminomethyl)naphthalene-2,3-dicarboximide, and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diazaoctane)bis(isothiuronium) trifluoroacetate and 2-(tribromomethylsulfonyl benzothiazole); and merocyanine dyes such as 3-ethyl-5-[(3-ethyl-2-benzothiazolinylidene)-1-methylethylidene]-2-thio-2,4-oazolidinedione; phthalazinone, phthalazinone derivatives or metal salts or these derivatives such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, e.g., phthalic acid, 4-methylphthalic acid, 4-nitrophthalic acid, and tetrachlorophthalic arthydride; quinazolinediones, benzoxazine or naphthoxazine derivatives; rhodium complexes e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asymtriazines, e.g., 2,4-dihydroxypyrimidine, 2-hydroxy-4-aminopyrimidine, and azauracil, and tetrazapentalene derivatives, e.g., 3,6-dimercapto-1,4-diphenyl-1H,4H-2,3a,5,6a-tetrazapentalene, and 1,4-di(o-chlorophenyl)-3,6-dimercapto-1H,4H-2,3a,5,6a-tetrazapentalene.

The azine in the silver (carboxylate-azine) particles of the invention is from the class of organic compounds known as azines having the general structure R1R2C═N—N═CR3R4. The azine structure preferably completes a six membered ring to form pyridazine or two six membered fused rings to form phthalazine and cinnoline. The rings can be substituted with for example, alkyl, substituted alkyl, hydroxy, alkoxy, and carboxy and carboxy-ester groups. Suitable azine compounds are: phthalazine, pyridazine, cinnoline, benzo(c) cinnoline, Examples of preferred substituted diazine compounds are: 1(2H)-phthalazinone, substituted 1(2H)-phthalazinones, 2,3-dihydro-1,4-phthalazinedione, substituted 2,3-dihydro-1,4-phthalazinediones and the like. In a particularly preferred embodiment the azine compound is phthalazine or a substituted phthalazine.

Other compounds can also be incorporated in silver-carboxylate particles. Silver-thiolates incorporated into the particles reduce the photographic fog associated with the compositions. The incorporation of silver thiolates is not our invention but is the invention of our coworkers, Ghyzel, Lelental, Dickinson, Pitt and Wear and is the subject of copending, commonly assigned U.S. Ser. No. 10/200,417 filed on the same date as this application. The preferred thiols are linear alkyl thiolates having alkyl chains of 2 to 24 carbons with the most preferred thiolates have alkyl chains of 6 to 18 carbons. Examples include but are not limited to silver 1-hexanethiolate, silver 1-dodecanethiolate, and silver 1-octadecanethiolate. The preferred level of silver-thiolate is from 0.1 to 1.2% by weight based on the weight of the silver-carboxylate. The thiols can be incorporated along with carboxylate and azine toner to produce a silver(carboxylate-azine toner-thiol) particle. Alternatively, particles of silver (carboxylate-thiol) can be prepared and used in combination with silver(carboxylate-azine toner) particles.

A number of surface modifiers can be used to facilitate the formation of nanoparticulate silver (carboxylate-azine) particles. Particular examples are disclosed in the following copending, commonly assigned applications: POLYACRYLAMIDE SURFACE MODIFIERS FOR SILVER CARBOXYLATE NANOPARTICLES, Lelental, Pitt, Dickinson, Wakley and Ghyzel, cited above; and PHOSPHORIC ACID ESTER SURFACE MODIFIERS FOR SILVER CARBOXYLATE NANOPARTICLES, Lelental, Dickinson, Wakley, Orem and Ghyzelalso cited above.

The preferred surface modifiers are polyacrylamide modifiers that are broadly defined by either of the following formulas:

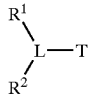

The number of hydrophobic groups (R or $R^1$ & $R^2$) depends on the linking group L. The hydrophobic group or groups comprise a saturated or unsaturated alkyl, aryl-alkyl or alkyl-aryl group where the alkyl parts can be straight or branched. Typically the groups R or $R^1$ & $R^2$ comprise 8–21 carbon atoms. The linking group L is linked to the hydrophobic groups by a simple chemical link and to the oligomeric part T by a thio link (—S—).

Typical linking groups for materials with one hydrophobic group are illustrated as follows:

(b)

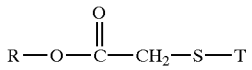

(c)

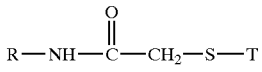

Typical linking groups for materials with two hydrophobic groups are illustrated as follows:

(d)

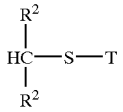

-continued (e)

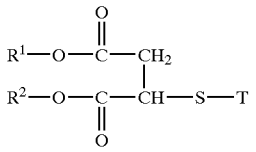

(f)

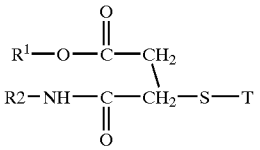

The oligomeric group T is based on the oligomerisation of vinyl monomers with an amido function, the vinyl part providing the route to oligomerisation and the amido part providing a nonionic polar group to constitute the hydrophilic functional group (after oligomerisation). The oligomeric group T can be made up from a single monomer source or a mixture of monomers provided the resulting oligomeric chain is sufficiently hydrophilic to render the resulting surface active material soluble or dispersible in water. Typical monomers used to create the oligomeric chain T are based on acrylamide, methacrylamide, derivatives of acrylamide, derivatives of methacrylamide and 2-vinylpyrollidone, though the latter is less favored due to adverse photographic effects sometimes found with polyvinyl pyrrolidone (PVP).

These monomers can be represented by two general formulas:

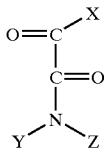

Acrylamide
Methacrylamide or
derivatives thereof

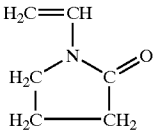

2-vinylpyrrolidone

X is typically H or $CH_3$, which leads to an acrylamide or methacrylamide based monomer respectively.

Y and Z' are typically H, $CH_3$, $C_2H_5$, $C(CH_2OH)_3$ where X and Y can be different or the same.

The described oligomeric surfactant based on vinyl polymer with an amido function can be made by methods that are known in the art or are simple modifications of known methods. An illustrative preparation is provided below.

In another aspect, the present invention provides a process for making aqueous silver (carboxylate-azine) particle dispersions.

Nanoparticulate silver (carboxylate-azine toner) particle dispersions can be prepared by a precipitation process commonly used for the precipitation of photographic silver halide emulsions. Into a conventional reaction vessel for silver precipitation equipped efficient stirring mechanism is introduced a surface modifier. Typically the surface modifier initially introduced into the reaction vessel is at least about 5 percent, preferably 10 to 30 percent, by weight based on total weight of the surface modifier present in the nanoparticulate-silver (carboxylate-toner) dispersion the conclusion of grain precipitation. Since surface modifier can be removed from the reaction vessel by ultrafiltration during silver (carboxylate-azine) particle dispersion precipitation, as taught by Mignot U.S. Pat. No. 4,334,012, it is appreciated that the volume of surface modifier initially present in the reaction vessel can equal or even exceed the volume of the silver-carboxylate, silver-azine toner particles present in the reaction vessel at the conclusion of grain precipitation. The surface modifier initially introduced into the reaction vessel is preferably aqueous solution or an aqueous dispersion of surface modifier, optionally containing other ingredients, such as one or more antifoggant and/or various dopants, more specifically described below. Where a surface modifier is initially present, it is preferably employed in a concentration of at least 5 percent, most preferably at least 10 percent, of the total surface modifier present at the completion of silver (carboxylate-azine) particle dispersion precipitation. Additional surface modifier can be added to the reaction vessel with the water-soluble silver salts and can also be introduced through a separate jet.

During precipitation silver carboxylate salts and azine toner compound(s) are added to the reaction vessel by techniques well known in the precipitation of photographic silver halide grains. The carboxylate salts are typically introduced as aqueous salt solutions, such as aqueous solutions of one or more soluble ammonium, alkali metal (e.g., sodium or potassium), or alkaline earth metal (e.g., magnesium or calcium) carboxylate salts. The water-soluble or water dispersible toner compound(s) and the silver salt are at least initially introduced into the reaction vessel separately from the carboxylate salt.

With the introduction of silver salt into the reaction vessel the nucleation stage of silver (carboxylate-azine) grain(s) formation is initiated. A population of grain nuclei is formed which is capable of serving as precipitation sites for silver (carboxylate-azine) particles or grains as the introduction of silver and (or) carboxylic acid salts and (or) azine toner compound(s) continues. The precipitation of silver (carboxylate-azine) particles onto existing grain nuclei constitutes the growth stage of nanoparticulate grain formation.

The silver, azine toner compound(s) and carboxylic salt or carboxylic acid grains are preferably very fine e.g., less than 1.0 micron in mean diameter. The concentrations and rates of silver, toner compound(s) and carboxylic acid salt introductions can take any convenient conventional form. The silver, azine toner compound(s) and carboxylic acid salts are preferably introduced in concentrations of from 0.1 to 5 moles per liter, although broader conventional concentration ranges, such as from 0.01 mole per liter to saturation, for example, are contemplated. Specifically preferred coprecipitation techniques are those which achieve shortened precipitation times by increasing the rate of silver, toner compound (s) and carboxylic acid salt introduction during the run. The rate of silver, toner compound(s) and or carboxylic acid salt introduction can be increased either by increasing the rate at which the silver and or carboxylic acid salts are introduced or by increasing the concentrations of the silver, toner compound(s) and carboxylic acid salts within the solution.

The individual silver and (or) toner compound(s) carboxylic acid salts can be added to the reaction vessel through surface or subsurface delivery tubes by gravity feed or by delivery apparatus for maintaining control of the rate of delivery and the pH, and/or pAg of the reaction vessel contents, as illustrated by Culhane et al. U.S. Pat. No. 3,821,002, Oliver U.S. Pat. No. 3,031,304 and Claes et al., Photographische Korrespondenz, Band 102, Nov. 10, 1967, p. 162. In order to obtain rapid distribution of the reactants within the reaction vessel, specially constructed mixing devices can be employed, as illustrated by Audran U.S. Pat. No. 2,996,287, McCrossen et al. U.S. Pat. No. 3,342,605, Frame et al. U.S. Pat. No. 3,415,650, Porter et al. U.S. Pat. No. 3,785,777, Finnicum et al. U.S. Pat. No. 4,147,551, Verhille et al. U.S. Pat. No. 4,171,224, Calamur U.K. Patent Application No. 2,022,431 A, Saito et al. German OLS Nos. 2,555,364 and 2,556,885, and Research Disclosure, Volume 166, February 1978, Item 16662.

In forming the silver (carboxylate-azine) particle dispersions a surface modifier is initially contained in the reaction vessel. In a preferred form the surface modifier is comprised of an aqueous solution. Surface modifier concentrations of from 0.1 to about 30 percent by weight, based on the total weight of dispersion components in the reaction vessel, can be employed. It is common practice to maintain the concentration of the surface modifier in the reaction vessel in the range of below about 15 percent, based on the total weight, prior to and during silver carboxylate-silver toner compound combination formation. It is contemplated that the silver (carboxylate-azine) particle dispersion as initially formed will contain from about 1 to 150 grams of surface modifier per mole of silver carboxylate preferably about 25 to 75 grams of surface modifier per mole of silver. Additional surface modifier can be added later to bring the concentration up to as high as 200 grams per mole of silver.

Vehicles (which include both binders and peptizers) can be employed. Preferred peptizers are hydrophilic colloids, which can be employed alone or in combination with hydrophobic materials. Suitable hydrophilic materials include substances such as proteins, protein derivatives, cellulose derivatives e.g., cellulose esters, gelatin e.g., alkali-treated gelatin (cattle bone or hide gelatin) or acid-treated gelatin (pigskin gelatin), gelatin derivatives e.g., acetylated gelatin, phthalated gelatin and the like, polysaccharides such as dextran, gum arabic, zein, casein, pectin, collagen derivatives, agaragar, arrowroot, albumin and the like as described in Yutzy et al. U.S. Pat. Nos. 2,614,928 and '929, Lowe et al., U.S. Pat. Nos. 2,691,582, 2,614,930, '931, 2,327,808 and 2,448,534, Gates et al. U.S. Pat. Nos. 2,787, 545 and 2,956,880, Himmelmann et al. U.S. Pat. No. 3,061, 436, Farrell et al. U.S. Pat. No. 2,816,027, Ryan U.S. Pat. Nos. 3,132,945, 3,138,461 and 3,186,846, Dersch et al. U.K. Pat. No. 1,167,159 and U.S. Pat. Nos. 2,960,405 and 3,436, 220, Geary U.S. Pat. No. 3,486,896, Gazzard U.K. Pat. No. 793,549, Gates et al. U.S. Pat. Nos. 2,992,213, 3,157,506, 3,184,312 and 3,539,353, Miller et al. U.S. Pat. No. 3,227, 571, Boyer et al. U.S. Pat. No. 3,532,502, Malan U.S. Pat. No. 3,551,151, Lohmer et al. U.S. Pat. No. 4,018,609, Luciani et al. U.K. Pat. No. 1,186,790, Hori et al. U.K. Pat. No. 1,489,080 and Belgian Pat. No. 856,631, U.K. Pat. No. 1,490,644, U.K. Pat. No. 1,483,551, Arase et al. U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al. U.S. Pat. No. 2,725,293, Hilborn U.S. Pat. No. 2,748,022, DePauw et al. U.S. Pat. No 2,956,883, Ritchie U.K. Pat. No. 2,095, DeStubner U.S. Pat. No. 1,752,069, Sheppard et al. U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al. U.S. Pat. No. 3,923,517.

Photosensitive silver halide grains made using water dispersible cationic starch to control fog can also be used. The use of cationic starch in photothermographic elements is not our invention but is the invention of our coworkers, Maskasky, Dickinson and Lelental and is described in copending, commonly assigned U.S. Ser. No. 09/703,050 filed Oct. 31, 2000.

Other materials commonly employed in combination with hydrophilic colloid peptizers as vehicles (including vehicle extenders—e.g., materials in the form of lattices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylarnide polymers, polypeptides and the like as described in Hollister et al. U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al. U.S. Pat. Nos. 2,484,456, 2,541,474 and 2,632,704, Perry et al. U.S. Pat. No. 3,425,836, Smith et al. U.S. Pat. Nos. 3,415,653 and 3,615,624, Smith U.S. Pat. No. 3,488, 708, Whiteley et al. U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al. U.S. Pat. No. 3,879,205, Nottorf U.S. Pat. No. 3,142,568, Houck et al. U.S. Pat. Nos. 3,062,674 and 3,220,844, Dann et al. U.S. Pat. No. 2,882,161, Schupp U.S. Pat. No. 2,579,016, Weaver U.S. Pat. No. 2,829,053, Alles et al. U.S. Pat. No. 2,698,240, Priest et al. U.S. Pat. No. 3,003,879, Merrill et al. U.S. Pat. No. 3,419,397, Stonham U.S. Pat. No. 3,284,207, Lohmer et al. U.S. Pat. No. 3,167,430, Williams U.S. Pat. Nos. 2,957, 767, Dawson et al. U.S. Pat. No. 2,893,867, Smith et al. U.S. Pat. Nos. 2,860,986 and 2,904,539, Ponticello et al. U.S. Pat. Nos. 3,929,482 and 3,860,428, Ponticello U.S. Pat. No. 3,939,130, Dykstra U.S. Pat. No. 3,411,911 and Dykstra et al. Canadian Pat. No. 774,054, Reamn et al. U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420, 455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al. U.S. Pat. Nos. 2,865,893 and 2,875,059, Rees et al. U.S. Pat. No. 3,536,491, Broadhead et al. U.K. Pat. No. 1,348,815, Taylor et al. U.S. Pat. No. 3,479,186, Merrill et al. U.S. Pat. No. 3,520,857, Bacon et al. U.S. Pat. No. 3,690,888, Bowman U.S. Pat. No. 3,748, 143, Dickinson et al. U.K. Pat. Nos. 808,227 and '228, Wood U.K. Pat. No. 822,192 and Iguchi et al. U.K. Pat. No. 1,398,055. These additional materials need not be present in the reaction vessel during nanoparticulate silver (carboxylate-azine) dispersion precipitation, but rather are conventionally added to the dispersion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers. The silver (carboxylate-azine) particle dispersions are preferably free of soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al. U.S. Pat. No. 2,618,556, Yutzy et al. U.S. Pat. No. 2,614,928, Yackel U.S. Pat. No. 2,565,418, Hart et al. U.S. Pat. No. 3,241,969, Waller et al. U.S. Pat. No. 2,489,341, Klinger U.K. Pat. No. 1,305,409 and Dersch et al. U.K. Pat. No. 1,167,159; by centrifugation and decantation of a coagulated dispersion as illustrated by Murray U.S. Pat. No. 2,463,794, Ujihara et al. U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al. Soviet Chemical Industry, Vol. 6, No. 3, 1974, pp.181–185; by diafiltration with a semipermeable membrane, as illustrated by Research Disclosure, Vol. 102, October 1972, Item 10208, Hagemaier et al. Research Disclosure, Vol. 131, March 1975, Item 13122, Bonnet Research Disclosure, Vol. 135, July 1975, Item 13577, Berg et al. German OLS No. 2,436,461, Bolton U.S. Pat. No. 2,495,918, and Mignot U.S. Pat. No. 4,334, 012, cited above, or by employing an ion exchange resin, as illustrated by Maley U.S. Pat. No. 3,782,953 and Noble U.S. Pat. No. 2,827,428.

In one aspect, there is provided an aqueous oxidation-reduction imaging forming composition comprising (i) a dispersion of silver-carboxylate and silver (carboxylate-azine) particles wherein the azine content of the particles is from about 0.01 to 10% by weight relative to silver carboxylate said particles having on the surface of the particles a surface modifier which is a nonionic oligomeric surfactant based on vinyl polymer with an amido function and (ii) an organic reducing agent. Such a composition is useful, for example, in a thermographic element. An image can be formed in such an element by imagewise heating. Imagewise heating can be accomplished using an array of heating elements as the element is passed through a machine similar to a facsimile machine.

In another aspect, the compositions of the invention can be used in photothermographic elements wherein a photosensitive silver halide is present. Exposure of the silver halide produces a latent image that is then developed by a composition of the invention including silver (carboxylate-azine) particles. An aqueous photothermographic composition according to the invention can be prepared by very thoroughly mixing (I) a hydrophilic photosensitive silver halide emulsion with (II) (a) a hydrophilic binder and (b) an oxidation-reduction image-forming composition comprising (i) an aqueous dispersion of silver-carboxylate and silver (carboxylate-azine toner) particles wherein the azine content of the particles is from about 0.01 to 10% by weight relative to silver carboxylate with (ii) an organic reducing agent in water. A photothermographic can be prepared by coating the resulting photothermographic composition on a suitable support.

The aqueous photothermographic materials can comprise a photosensitive silver halide. The photosensitive silver halide is in the form of a hydrophilic photosensitive silver halide emulsion containing a gelatino peptizer. The photosensitive silver halide is especially useful due to its high degree of photosensitivity compared to other photosensitive components.

Spectral sensitization is the addition of compounds to silver halide grains which absorb radiation at wavelengths other than those to which silver halide is naturally sensitive (i.e., only within the UV to blue) or which absorb radiation more efficiently than silver halide (even within those natural regions of spectral sensitivity). It is generally recognized that spectral sensitizers extend the responses of photosensitive silver halide to longer wavelengths and can accomplish spectral sensitization the UV, visible or infrared regions of the electromagnetic spectrum. These compounds, after absorption of the radiation, transfer energy to the silver halide grains to cause the necessary local photoinduced reduction of silver salt to silver metal. The compounds are usually dyes, and the best method of spectrally sensitizing silver halide grains causes or allows the dyes to align themselves on the surface of the silver halide grain, particularly in a stacked, almost crystalline pattern on the surface of the individual grains.

Many cyanine and related dyes are well known for their ability to impart spectral sensitivity to a gelatino silver halide element. The wavelength of peak sensitivity is a function of the dye's wavelength of peak light absorbance. While many such dyes provide some spectral sensitization in photothermographic formulations, the dye sensitization is often very inefficient and it is not possible to translate the performance of a dye in gelatino silver halide elements to photothermographic elements. The emulsion making procedures and chemical environment of photothermographic elements are very harsh compared to those of gelatino silver halide elements. The presence of large surface areas of fatty acids and fatty acid salts as well as other components of photothermographic formulations restricts the surface deposition of sensitizing dyes onto silver halide surfaces and may remove sensitizing dye from the surface of the silver halide grains. The large variations in pressure, temperature, pH and solvency encountered in the preparation of photothermographic formulation aggravate the problem. Thus sensitizing dyes that perform well in gelatino silver halide elements are often inefficient in photo-thermographic formulations. In general, it has been found that merocyanine dyes are superior to cyanine dyes in photothermographic formulations as disclosed, for example, in British Patent No 1,325,312 and U.S. Pat. No. 3,719,495. Recently, certain cyanine dyes have been disclosed as spectral sensitizers for use in photothermographic elements. For example, U.S. Pat. Nos. 5,441,866 and 5,541,054 describe photothermographic elements spectrally sensitized with benzothiazole heptamethine dyes substituted with various groups, including alkoxy and thioalkyl. Although spectral sensitizing dyes for photothermographic elements are now known which absorb through-out the visible and near-infrared regions (i.e., 400–850 nm) photothermographic emulsions which provide higher photographic speeds and which have improved shelf-life stability, sensitivity, contrast and low Dmin are still needed for photothermography. U.S. Pat. No. 4,207,108 (Hiller) describes improved speed in photothermographic materials by addition of a photographic speed increasing concentration of a certain non-dye, thione speed increasing addendum (including compounds with cyclic thiocarbonyl [>COS] groups within the cyclic structure). No decomposition of the cyclic thione compounds is reported. U.S. Pat. No. 5,541,055 (Ooi et al.) describes photothermographic elements that comprise both a cyanine dye and a colorless cyclic carbonyl compound. Rhodanine, hydantoin, barbituric acid, or derivatives thereof (all shown to be monocyclic in columns 4–6) are particularly preferred as the colorless cyclic carbonyl compound. The recent commercial availability of relatively high powered semiconductor light sources, and particularly laser diodes which emit in the red and near-infrared region of the electromagnetic spectrum, as sources for out-put of electronically stored image data onto photosensitive film or paper is becoming increasingly wide spread. This has led to a need for high quality imaging articles, which are sensitive at these wavelengths, and has created a need for more highly sensitive photothermographic elements to match such exposure sources both in wavelength and intensity.

To get the speed of the photothermographic elements up to maximum levels and further enhance sensitivity, it is often desirable to use supersensitizers. Any supersensitizer can be used which increases the sensitivity. For example, preferred infrared supersensitizers are described in U.S. patent application Ser. No. 08/091,000 (filed Jul. 13, 1993) and include heteroaromatic mercapto compounds or heteroaromatic disulfide compounds of the formulae: Ar—S—M and Ar—S—S—Ar, wherein M represents a hydrogen atom or an alkali metal atom. In the above noted supersensitizers, Ar represents a heteroaromatic ring or fused heteroaromatic ring containing one or more of nitrogen, sulfur, oxygen, selenium or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline or quinazolinone. However, other heteroaromatic rings are envisioned under the breadth of this invention. The heteroaromatic ring may also carry substituents with examples of preferred substituents being selected from the group consisting of halogen (e.g., Br and Cl), hydroxy, amino, carboxy, alkyl (e.g., of 1 or more carbon atoms, preferably 1 to 4 carbon atoms) and alkoxy (e.g., of 1 or more carbon atoms, preferably of 1 to 4 carbon atoms. Most preferred supersensitizers are 2-mercaptobenzimidazole, 2-mercapto-5-methylbenzimidazole (MMBI), 2-mercaptobenzothiazole, and 2-mercaptobenzoxazole (MBO). The supersensitizers are used in general amount of at least 0.001 moles of sensitizer per mole of silver in the emulsion layer. Usually the range is between 0.001 and 1.0 moles of the compound per mole of silver and preferably between 0.01 and 0.3 moles of compound per mole of silver.

A typical concentration of hydrophilic photosensitive silver halide emulsion containing a gelatino peptizer and the imaging forming composition according to the invention is within the range of about 0.02 to about 1.0 mole of photosensitive silver halide per mole of the described silver (carboxylate-azine) particles in the photothermographic material. Other photosensitive materials can be useful in combination with the described photosensitive silver halide if desired. Preferred photosensitive silver halides are silver chloride, silver bromoiodide, silver bromide, silver chlorobromoiodide or mixtures thereof. For purposes of the invention, silver iodide is also considered to be a photosensitive silver halide. A range of grain size and grain morphology of photosensitive silver halide from very coarse grain to very fine grain and from 3D to tabular silver halide is useful. Tabular grain photosensitive silver halide is useful, as described in, for example, U.S. Pat. No. 4,435,499. Very fine grain silver halide is typically preferred.

The hydrophilic photosensitive silver halide emulsion containing a gelatino peptizer can be prepared by any of the procedures known in the photographic art which involve the preparation of photographic silver halide gelatino emulsion. Useful procedures and forms of photosensitive silver halide gelatino emulsions for purposes of the invention are described in, for example, the Product Licensing Index, Volume 92, December 1971, Publication 9232 on page 107, published by Industrial Opportunities Limited, Homewell, Havant Hampshire, P091 EF, UK. The photographic silver halide, as described, can be washed or unwashed, can be chemically sensitized using chemical sensitization procedures. Materials known in the photographic art can be protected against the production of fog and stabilized against loss of sensitivity during keeping as described in the mentioned Product Licensing Index publication.

A hydrophilic photosensitive silver halide emulsion containing a gelatino peptizer that contains a low concentration of gelatin is often very useful. The concentration of gelatin that is very useful is typically within the range of about 9 to about 40 grams per mole of silver.(The term "hydrophilic" is intended herein to mean that the photosensitive silver halide emulsion containing a gelatino peptizer is compatible with an aqueous solvent.)

The gelatino peptizer that is useful with the photosensitive silver halide emulsion can comprise a variety of gelatino peptizers known in the photographic art. The gelatino peptizer can be, for example, phthalated gelatin or non-phthalated gelatin. Other gelatino peptizers that are useful include acid or base hydrolyzed gelatins. A non-phthalated gelatin peptizer is especially useful with the described photosensitive silver halide emulsion.

The photosensitive silver halide emulsion can contain a range of concentration of the gelatino peptizer. Typically, the concentration of the gelatino peptizer is within the range of about 5 grams to about 60 grams of gelatino peptizer, such as gelatin, per mole of silver in the silver halide emulsion. This is described herein as a low-gel silver halide emulsion. An especially useful concentration of gelatino peptizer is within the range of about 10 to about 25 grams of gelatino peptizer per mole of silver in the silver halide emulsion. The optimum concentration of the gelatino peptizer will depend upon such factors as the particular photosensitive silver halide, the desired image, the particular components of the photothermographic composition, coating conditions and the like.

The temperature of the reaction vessel within which the silver halide emulsion is prepared is typically maintained within a temperature range of about 35° C. to about 75° C. during the composition preparation. The temperature range and duration of the preparation can be altered to produce the desired emulsion grain size and desired composition properties. The silver halide emulsion can be prepared by means of emulsion preparation techniques and apparatus known in the photographic art.

A variety of hydrophilic binders are useful in the described photothermographic materials. The binders that are useful include various colloids alone or in combination as vehicles and/or binding agents. The hydrophilic binders which are suitable include transparent or translucent materials and include both naturally occurring substances, such as proteins, gelatin, gelatin derivatives, cellulose derivatives, polysaccharides, such as dextrin, gum arabic and the like: and synthetic polymeric substances such as water-soluble polyvinyl compounds like polyvinyl alcohol, poly (vinyl pyrrolidone), acrylamide polymers and the like. Other synthetic polymeric compounds, which can be employed, include dispersed vinyl compounds such as latex form and particularly those that increase dimensional stability of photographic materials. A range of concentration of hydrophilic binder can be useful in the photothermographic silver halide materials according to the invention. Typically, the concentration of hydrophilic binder in a photothermographic silver halide composition according to the invention is within the range of about 0.5 to about 10 g/m2. An optimum concentration of the described binder can vary depending upon such factors as the particular binder, other components of the photothermographic material, coating conditions, desired image, processing temperature and conditions and the like.

If desired, a portion of the photographic silver halide in the photothermographic composition according to the invention can be prepared in situ in the photothermographic material. The photothermographic composition, for example, can contain a portion of the photographic silver halide that is prepared in or on one or more of the other components of the described photothermographic material rather than prepared separate from the described components and then admixed with them. Such a method of preparing silver halide in situ is described in, for example, U.S. Pat. No. 3,457,075 of Morgan et al., issued Jul. 22, 1969.

The described photothermographic composition comprises an oxidation-reduction image-forming combination containing silver (carboxylate-azine) particles, with a suitable reducing agent. The oxidation-reduction reaction resulting from this combination upon heating is believed to be catalyzed by the latent image silver from the photosensitive silver halide produced upon imagewise exposure of the photothermographic material followed by overall heating of the photothermographic material. The exact mechanism of image formation is not fully understood.

A variety of organic reducing agents are useful in the described photothermographic silver halide materials. These are typically silver halide developing agents that produce the desired oxidation-reduction image-forming reaction upon exposure and heating of the described photothermographic silver halide material. Examples of useful reducing agents include: polyhydroxybenzenes, such as hydroquinone and alkyl substituted hydroquinones; catechols and pyrogallol; phenylenediamine developing agents; aminophenol developing agents; ascorbic acid developing agents, such as ascorbic acid and ascorbic acid ketals and other ascorbic acid derivatives; hydroxylamine developing agents; 3-pyrazolidone developing agents such as 1-phenyl-3-pyrazolidone and 4-methyl-4-hydroxymethyl-1-phenyl-3-pyrazolidone; hydroxytetronic acid and hydroxytetronamide developing agents; reductone developing agents; bis-naphthol reducing agents; sulfonamidophenol reducing agents: hindered phenol reducing agents and the like. Combinations of organic reducing agents can be useful in the described photothermographic silver halide materials. Sulfonamidophenol developing agents, such as described in Belgian Pat. No. 802,519 issued Jan. 18, 1974 can be especially useful in the photothermographic silver halide composition.

A range of concentration of the organic reducing agent can be useful in the described photothermographic silver halide materials. The concentration of organic reducing agent is typically within the range of about 0.5 g/m2 to about 5g/m2, such as within the range of about 1.0 to about 3.0 g/m2. The optimum concentration of organic reducing agent will depend upon such factors as the particular carboxylate, e.g. long-chain fatty acid, the desired image, processing conditions, the particular solvent mixture, coating conditions and the like.

The order of addition of the described components for preparing the photothermographic composition before coating the composition onto a suitable support is important to obtain optimum photographic speed, contrast and maximum density.

Various mixing devices are useful for preparing the described compositions. However, the mixing device should be one that provides very thorough mixing. Mixing devices that are useful are commercially available colloid mill mixers and dispersator mixers known in the photographic art.

Photothermographic materials according to the invention can contain other addenda that are useful in imaging. Suitable addenda in the described photothermographic materials include development modifiers that function as speed-increasing compounds, hardeners, antistatic layers, plasticizers and lubricants, coating aids, brighteners, spectral sensitizing dyes, antifogants, charge control agents, absorbing and filter dyes, matting agents and the like.

The specific addenda depend on the exact nature of the imaging element. The present invention is useful for forming laser output media useful for reproducing x-ray images; it is useful for forming microfilm elements and it is useful to form graphic arts elements. Each of these applications has well known features requiring specialized addenda known in the respective arts for these elements.

As noted, the present invention provides silver (carboxylate-azine) particles. An important advantage of these compositions is that they can be coated from an aqueous environment. Several current elements of this type are currently coated from organic solvents. The described materials can be used to convert these products into aqueous coated products, particularly where the particles are nanoparticulate. In this process, some of the components that are typically found in these elements might not be as soluble in water as desired. These components also can be made into nanoparticulate dispersions using the same or compatible surface modifiers as are described.

It is useful in certain cases to include a stabilizer in the described photothermographic material. This can help in stabilization of a developed image. Combinations of stabilizers can be useful if desired. Typical stabilizers or stabilizer precursors include certain halogen compounds, such as tetrabromobutane and 2-(tribromomethyl)sulfonyl, benzothiazole, which provide improved postprocessing stability and azothioethers and blocked azoline thione stabilizer precursors.

A photothermographic element according to the invention can have a transparent protective layer comprising a film forming binder, preferable a hydrophilic film forming binder. Such binders include, for example, crosslinked polyvinyl alcohol, gelatin, poly (silicic acid), and the like. Particularly preferred are binders comprising poly (silicic acid) alone or in combination with a water-soluble hydroxyl-containing monomer or polymer as described in the U.S. Pat. No. 4,828,971.

The term "protective layer" is used to mean a transparent, image insensitive layer that can be an overcoat layer, that is a layer that overlies the image sensitive layer(s). The protective layer can also be a backing layer, that is, a layer that is on the opposite side of the support from the image sensitive layer(s). The imaging element can contain an adhesive interlayer or adhesion promoting interlayer between the protective layer and the underlying layer(s). The protective layer is not necessarily the outermost layer of the imaging element.

The protective layer can contain an electrically conductive layer having a surface resistivity of less than $5\times10^{11}$ ohms/square. Such electrically conductive overcoat layers are described, for example, in U.S. Pat. No. 5,547,821.

A photothermographic imaging element can include at least one transparent protective layer containing matte particles. Either organic or inorganic matte particles can be used. Examples of organic matte particles are beads of polymers such as polymeric esters of acrylic and methacrylic acid, e.g., poly (methylmethacrylate), styrene polymers and copolymers, and the like. Examples of inorganic matte particles are glass, silicon dioxide, titanium dioxide, magnesium oxide, aluminum oxide, barium sulfate, calcium carbonate, and the like. Matte particles and the way they are used are further described in U.S. Pat. Nos. 3,411,907, 3,754,924, 4,855,219, 5,279,934, 5,288,598, 5,378,577, 5,563,226 and 5,750,328.

A wide variety of materials can be used to prepare the protective backing layer that is compatible with the requirements of photothermographic elements. The protective layer should be transparent and should not adversely affect sensitometric characteristics of the photothermographic element such as minimum density, maximum density and photographic speed. Useful protective layers include those comprised of poly (silicic acid) and a water-soluble hydroxyl containing monomer or polymer that is compatible with poly (silicic acid) as described in U.S. Pat. Nos. 4,741,992 and 4,828,971, the entire disclosures of which are incorporated herein by reference. A combination of poly (silicic acid) and poly (vinyl alcohol) is particularly useful. Other useful protective layers include those formed from polymethylmethacrylate, acrylamide polymers, cellulose acetate, crosslinked polyvinyl alcohol, terpolymers of acrylonitrile, vinylidene chloride, and 2-(methacryloyloxy) ethyl-trimethylammonium methosulfate, crosslinked gelatin, polyesters and polyurethanes.

Particularly preferred protective layers are described in above-mentioned U.S. Pat. Nos. 5,310,640 and 5,547,821.

The photothermographic elements can comprise a variety of supports that can tolerate the processing temperatures useful in developing an image. Typical supports include cellulose ester, poly(vinyl acetal), poly(ethylene terephthalate), polycarbonate and polyester film supports. Related film and resinous support materials, as well as paper, glass, metal and the like supports that can withstand the described processing temperatures are also useful. Typically a flexible support is most useful.

Coating procedures known in the photographic art can coat the photothermographic compositions on a suitable support. Useful methods including dip coating, air-knife coating, bead coating using hoppers, curtains coating or extrusion coating using hoppers. If desired, two or more layers can be coated simultaneously.

The described silver halide and oxidation-reduction image-forming combination can be in any suitable location in the photothermographic element which produces the desired image. In some cases it can be desirable to include certain percentages of the described reducing agent, the silver salt oxidizing agent and/or other addenda in a protective layer or overcoat layer over the layer containing the other components of the element as described. The components, however, must be in a location that enables their desired interaction upon processing.

It is necessary that the photosensitive silver halide, as described and other components of the imaging combination are "in reactive association" with each other in order to produce the desired image. The term "in reactive association," as employed herein, is intended to mean that the photosensitive silver halide and the image-forming combination are in a location with respect to each other, which enables the desired processing and produces a useful image.

A useful embodiment of the invention is a photothermographic silver halide composition capable of being coated on a support. The composition comprises (a) an aqueous photosensitive silver halide emulsion containing a gelatin peptizer with (b) a hydrophilic polymeric binder consisting essentially of a gelatin and (c) an oxidation-reduction image-forming combination comprising (i) a silver carboxylate and the described silver (carboxylate-azine toner) particles and a surface modifier as described (ii) an organic reducing agent consisting essentially of a hindered phenol. This composition can be coated on a suitable support to produce a photothermographic element. Another embodiment is a method of preparing a photothermographic element comprising coating the resulting composition onto a suitable support to produce a photothermographic element as desired.

Elements can be imaged using a variety of methods. The elements can be imaged using any suitable source of infrared radiation to which the photothermographic material is sensitive. Typically, a photothermographic material is exposed imagewise with an infrared light source, such as a laser or a light emitting diode (LED) to produce a developable latent image.

A visible image can be developed in the photothermographic material within a short time, such as within several seconds, merely by heating the photothermographic material to moderately elevated temperatures. For example, the exposed photothermographic material can be heated to a temperature within the range of about 100° C. to about 200° C., such as a temperature within the range of about 110° C. to about 140° C. Heating is carried out until a desired image is developed, typically within about 2 to about 60 seconds, such as 8 to 30 seconds. Selection of an optimum processing time and temperature will depend upon such factors as the desired image, particular components of the photothermographic element, the particular latent image and the like.

The necessary heating of the described photothermographic material to develop the desired image can be accomplished in a variety of ways. Heating can be accomplished using a simple hot plate, iron, roller, infrared heater, hot air or the like.

Processing is typically carried out under ambient conditions of pressure and humidity. Pressures and humidity outside normal atmospheric conditions can be useful if desired; however, normal atmospheric conditions are preferred.

EXAMPLES

Example 1

Procedure for Precipitation of Nanoparticulate Colloidal Dispersion Comprising Silver(Behenate-Phthalazine Toner) Particles Starting Materials Demineralized water Nominally 90% Behenic Acid (Unichema) recrystallized from isopropanol to purify ML-41 Surfactant (described in Published application US20010031436 A1 2001/08/18)

12.77%(w/w) aqueous silver nitrate 10.81% (w/w) aqueous potassium hydroxide 1-dodecanethiol phthalazine

Precipitation Procedure

A 20 gallon reactor was charged with 31.5 kg of water, 135 g ML-41, 4.05 g 1-dodecanethiol and 925.6 g of behenic acid. The contents were stirred at 150 RPM with a retreat curve stirrer and heated to 70° C. Once the mixture reached 70° C., 1243.6 g of 10.81% aqueous potassium hydroxide and 26.2 g of phthalazine were added to the reactor. The mixture was heated to 80° C. and held there for 30 minutes. The mixture was then cooled to 70° C. When the reactor reached 70° C., 3125 g of 12.77% aqueous silver nitrate were fed to the reactor in 5 minutes. After the addition, the nanoparticulate silver (behenate-phthalazine toner) compound combination was held at the reaction temperature for 30 minutes. It was then cooled to room temperature and washed by ultrafiltration. A silver (behenate-phthalazine toner) compound combination dispersion with a median particle size of 160 nm was obtained.

Example 2

Aqueous Photothermographic Imaging Element Formulated Using Nanoparticulate Ag (Beh-Phthalazine Toner) Dispersion Made Using Controlled Precipitation The photosensitive emulsion layer was prepared by combining at 40° C., 55 grams of 35% aqueous solution of gelatin peptizer (cattle bone, alkali treated, deionized gelatin) with 109.8 grams of water and 128.4 grams of an aqueous nanoparticulate silver (behenate-phthalazine toner) particle dispersion prepared as described in Example 1. To this mixture was added 2.8 grams of a 25 g/l aqueous solution of AF-1, 0.96 grams of solid particle dispersion of AF-2 (described below), 2.72 grams of succinimide toner and 3.97 grams of 50 g/l aqueous solution of sodium iodide. This mixture was combined with 35.0 grams of a solid particle dispersion of developer Dev-1 (described below) and was stirred overnight. A primitive iodobromide cubic emulsion, Br97%I3%, 48 nanometer in edge length and containing 20g gelatin per mole silver was melted at 40 C and was spectrally sensitized at 40 C by combining 9.44 grams of emulsion 0.775 kg/mol Ag with 6.07 grams of a 3 g/l aqueous solution of D-1 (described below) followed by addition of 0.99 grams of a 7 g/l methanolic solution of D-2 (described below). This mixture was held for 10 minutes and chill set. Prior to coating at 40° C. the silver behenate containing mixture described above was combined with 14.8 grams of spectrally sensitized emulsion with good stirring. To this mixture was added 3.89 grams of a solution made by adding 100 g/ of 4-methyl phthalic acid and 76 g/l of sodium bicarbonate.

The solid particle dispersion of the developer Dev-1 had been prepared by milling a 20% solution of Dev-1 with 0.8% SDS in water. The solid particle dispersion of AF-2 had been prepared by milling a 20% solution of AF-2 with 2.0% of Triton® X-200 (Rohm and Haas, Philadelphia Pa.) in water.

A thermally processable imaging element was prepared by coating a gelatin subbed poly(ethylene terephthalate) support, having a thickness of 0.178 mm, with a photothermographic imaging layer and a protective overcoat. The layers of the thermally processable imaging element were coated on a support using an extrusion coating hopper. The photothermographic imaging composition was coated from aqueous solution at a wet coverage of 97.8 g/m2 to form an imaging layer of the following dry composition

TABLE 1

Photothermographic Imaging Layer dry coverage

| Components | | Dry Coverage ($g/m^2$) |
|---|---|---|
| Succinimide | | 0.761 |
| 4-methyl phthalic acid | | 0.109 |
| Dev-1 | | 1.935 |
| Emulsion cubic edge 0.048 micron | as silver | 0.283 |
| D-1 | | 0.00391 |
| D-2 | | 0.00117 |
| Silver behenate | | 7.652 |
| Gelatin | | 5.435 |
| Sodium Iodide, USP | | 0.055 |
| AF-1 | | 0.0196 |
| AF-2 | | 0.0543 |

The resulting imaging layer was then overcoated with mixture of polyvinyl alcohol and hydrolyzed tetraethyl orthosilicate as described in Table 2 at a wet coverage of 40.4 cc/$m^2$ and dry coverage shown in Table 3.

TABLE 2

| Overcoat Solution | |
|---|---|
| Component | Grams |
| Distilled Water | 1158.85 grams |
| Polyvinyl Alcohol (PVA, Elvanol ® 52-22 from DuPont, 86–89% hydrolyzed) (6.2% by weight in distilled water) | 763.43 |
| Tetraethyl Orthosilicate solution comprising of 178.5 grams of water 1.363 grams of p-Toluene Sulfonic Acid, 199.816 grams of Methanol, 207.808 grams of Tetraethyl Orthosilicate | 489.6 |
| Aerosol ® TO (0.15% by weight in distilled water. (Aereosol TO is a sodium bis-2-ethylhexyl sulfosuccinate surfactant and is available from the Cytec Industries, Inc.., U.S.A.) | 75.00 |

TABLE 2-continued

| Overcoat Solution | |
|---|---|
| Component | Grams |
| Zonyl ® FSN (0.05% by weight in distilled water. (Zonyl FSN surfactant is a mixture of fluoro-alkyl poly(ethyleneoxide) alcohols and is a trademark of and available from the Dupont Corp., U.S.A.) | 3.13 |
| Silica (1.5 micron) | 3.0 |

TABLE 3

| Overcoat layer dry coverage | |
|---|---|
| PSA (Silicate) | 1.302 |
| PVA | 0.872 |
| Aerosol ® TO | 0.0624 |
| Zonyl ® FSN | 0.0207 |

Structures of Components in Example 2

D-1

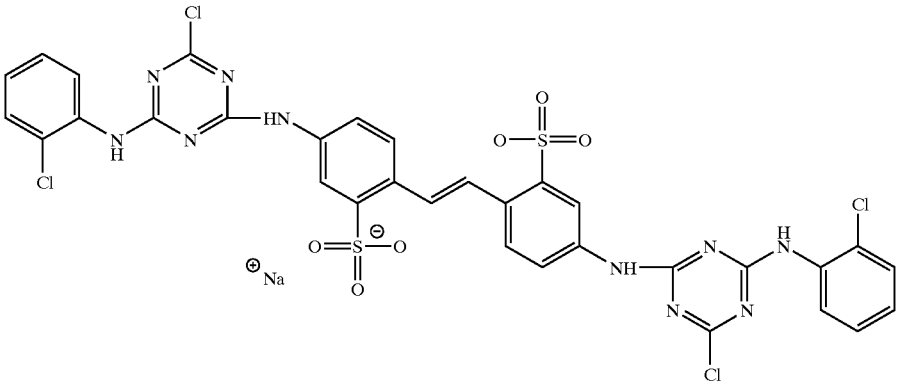

D-2

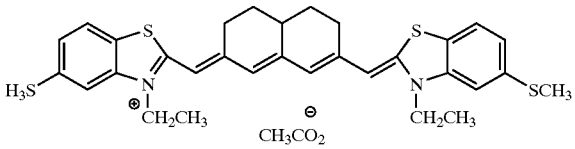

AF-1

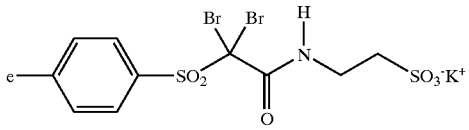

AF-2

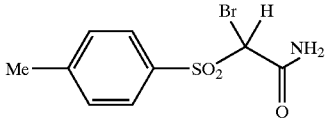

Developer Dev-1

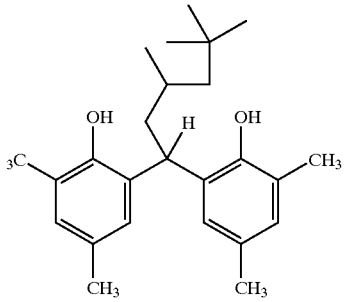

SDS $H_3(CH_2)_{11}$—$SO_4^-Na^+$

The coating of Example 2 was exposed using the 810 nm, 50 mW, diode laser sensitometer and heat processed at 122° C. for 15 sec to produce a developed silver image density Dmax=3.59 and Dmin=0.065, see Table 4.

Control Example 3

Procedure for Precipitation of Silver-Behenate, Phthalazine-Free, Nanoparticulate Colloidal Dispersion A nanoparticulate, phthalazine-free, silver-bebenate colloidal dispersion was prepared as described in Example 1 except phthalazine toner was not included in the reaction mixture during the precipitation.

Control Example 4

IR Sensitive Aqueous Photothermographic Imaging Element Formulated Using Phthalazine—Free AgBeh Dispersion A photothermographic element was formulated, coated, exposed and heat processed as described in Example 2 except that the silver (behenate-silver phthalazine toner) compound combination nanoparticulate dispersion of Example 1 was replaced with the phthalazine-free nanoparticulate AgBeh dispersion of Example 3.

The imaging element was exposed and processed as described in Example 2 to produce a developed silver image having sensitometric characteristics as shown in Table 4.

The maximum density for the element of the invention is much higher than for an element having "free" toner.

Examples 5–16

Photothermographic elements were formulated using silver source dispersions and silver halide coverages listed in Table 4a, and coated, as described in Example 2.

The imaging elements were exposed and heat processed as described in Example 2 to produce a developed silver image having sensitometric characteristics as shown in Table 4.

Examples 17–20

Photothermographic elements were formulated using silver source dispersions and silver halide coverages described in Control Example 6, and coated, as described in Example 2.

The exposed imaging elements were exposed and heat processed as described in Example 2 to produce sensitometric response as shown in Table 4b.

Preparation of Silver-Phthalazine 1:1 Dispersion For Use in Control

Examples 17 and 18

A silver-phthalazine dispersion (1:1 molar ratio) was prepared by first dissolving 1.96 g phthalazine and 0.78 g of 35% gelatin solution (cattle bone, alkali treated, deionized gelatin) in 37.2 g demineralized water. This solution was stirred vigorously at room temperature while adding 4.70 g of 5.72 M AgNO3 solution.

Control Example 17

The silver-phthalazine dispersion (1:1 molar ratio) prepared above was introduced into photothermographic imaging elements similar to Example 4 at a level equivalent to 0.0435 g/m2 phthalazine.

Control Example 18

The silver-phthalazine dispersion (1:1 molar ratio) prepared above was introduced into photothermographic imaging elements similar to Control Example 4 at a level equivalent to 0.087 g/m2 phthalazine.

Preparation of Silver-Phthalazine 1:2 Dispersion For Use in Control Examples 19 and 20

A silver-phthalazine (1:2 molar ratio) dispersion was prepared by adding a solution of 0.333 g AgNO3 and 0.61 g gelatin (cattle bone, alkali treated, deionized gelatin) in 5.14 g water into a 40° C. stirred solution prepared from 0.5 g phthalazine, 1.0 g gelatin (cattle bone, alkali treated, deionized gelatin) and 8.5 g of demineralized water.

Control Example 19

The silver-phthalazine (1:2 molar ratio) dispersion prepared above was introduced into photothermographic imaging elements similar to Example 4 at a level equivalent to 0.0323 g/m2 phthalazine.

Control Example 20

The silver-phthalazine (1:2 molar ratio) dispersion prepared above was introduced into photothermographic imaging elements similar to Example 4 at a level equivalent to 0.0646 g/m2 phthalazine.

Control Example 21

This control example was prepared similarly to that of Example 2 except that the Nanoparticulate AgBeh used was free of phthalazine and the amount of sodium iodide was reduced to 0.011 g/m$^2$.

Example 22

Aqueous Photothermographic Imaging Element Formulated Using Nanoparticulate Ag(Beh-Phtahlazine) Dispersion and Nanoparticulate AgBeh Preparation of Dispersion Ph1

A mixture of 2.5 g dodecylthiopolyacrylamide, 0.65 g phthalazine, 1.88 g behenic acid, 215 g distilled water, and 5.0 ml of 1 M NaOH were heated at ~90° C. until all components had dissolved. The resulting solution was stirred at 80° C. while 48.3 g of 0.10M $AgNO_3$ solution was rapidly added requiring ~2 sec. The mixture was rapidly cooled to 14° C.

Examination of the resulting dispersion by electron microscopy showed an average particle size of 50 nanometers. X-ray powder diffraction spectrum of this sample showed that the predominate peaks were those of AgBeh.

Example 22 Coating

This example coating was prepared similarly to that of Control Example 21 except that 34.0 g of Dispersion Ph1 was added in addition to the phthalazine free AgBeh. The resulting coating contained 0.29 wt % phthalazine relative to the total weight of AgBeh and 0.13 wt % phthalazine relative to the total weight of the emulsion layer.

The coatings of Control Example 21 and Example 22 were exposed and processed as described in Example 2. The sensitimetric results are given in Table 4b. The resulting image of Example 22 had a more neutral image tone (more desirable), higher Dmax, and greater speed than that of Control Example 21.

TABLE 4a

| Example # | Example | AgBr as Ag g/m2 | Silver Source Dispersion | Silver (Behenate - Phthalazine Toner) g/m2 of Phthalazine | Phthalazine (Free or Ag Salt) g/m2 of Phthalazine |
|---|---|---|---|---|---|
| 2 | Invention | 0.283 | Ag (Beh-Ph) | 0.348 | 0 |
| 4 | Comparative | 0.283 | AgBeh | 0 | 0 |
| 5 | Invention | 0.175 | Ag (Beh-Ph) | 0.348 | 0 |
| 6 | Comparative | 0.175 | AgBeh | 0 | 0 |
| 7 | Comparative | 0.283 | AgBeh | 0 | 0.174 |
| 8 | Invention | 0.175 | Ag (Beh-Ph) | 0.696 | 0 |
| 9 | Comparative | 0.175 | AgBeh | 0 | 0 |
| 10 | Invention | 0.283 | Ag (Beh-Ph) | 0.174 | 0 |
| 11 | Comparative | 0.283 | AgBeh | 0 | 0 |
| 12 | Comparative | 0.283 | AgBeh | 0 | 0 |
| 13 | Comparative | 0.283 | AgBeh | 0 | 0.00087 |
| 14 | Comparative | 0.283 | AgBeh | 0 | 0.00174 |
| 15 | Comparative | 0.283 | AgBeh | 0 | 0.00870 |
| 16 | Comparative | 0.283 | AgBeh | 0 | 0.01739 |
| 17 | Comparative | 0.283 | AgBeh | 0 | 0.0435 |
| 18 | Comparative | 0.283 | AgBeh | 0 | 0.0870 |
| 19 | Comparative | 0.283 | AgBeh | 0 | 0.0323 |
| 20 | Comparative | 0.283 | AgBeh | 0 | 0.0646 |
| 21 | Comparative | 0.283 | AgBeh | 0 | 0 |
| 22 | Comparative | 0.283 | AgBeh + Ag (Beh-Ph) | 0.022 | 0 |

TABLE 4b

| # | Example | Dmin | Dmax | Speed@1* | Speed@2* |
|---|---|---|---|---|---|
| 2 | Invention | 0.07 | 3.59 | 1.52 | 1.32 |
| 4 | Comparative | 0.07 | 2.80 | 1.50 | 1.30 |
| 5 | Invention | 0.09 | 2.82 | 1.39 | 1.15 |
| 6 | Comparative | 0.09 | 1.88 | 1.40 | 1.00 |
| 7 | Comparative | 1.49 | 1.49 | no image | no image |
| 8 | Invention | 0.05 | 2.95 | 1.30 | 1.05 |
| 9 | Comparative | 0.06 | 1.52 | 1.20 | 1.00 |
| 10 | Invention | 0.07 | 3.10 | 1.37 | 1.22 |
| 11 | Comparative | 0.06 | 2.74 | 1.42 | 1.23 |
| 12 | Comparative | 0.07 | 2.84 | 1.39 | 1.19 |
| 13 | Comparative | 0.07 | 2.80 | 1.40 | 1.17 |
| 14 | Comparative | 0.07 | 2.55 | 1.32 | 1.09 |
| 15 | Comparative | 0.07 | 2.23 | 1.08 | 0.74 |
| 16 | Comparative | 0.07 | 2.39 | 1.00 | 0.76 |
| 17 | Comparative | 0.18 | no image | no image | no image |

TABLE 4b-continued

| # | Example | Dmin | Dmax | Speed@1* | Speed@2* |
|---|---|---|---|---|---|
| 18 | Comparative | 0.11 | no image | no image | no image |
| 19 | Comparative | 0.10 | no image | no image | no image |
| 20 | Comparative | 0.12 | no image | no image | no image |
| 21 | Comparative | 0.07 | 2.57 | 1.43 | 1.19 |
| 22 | Invention | 0.16 | 3.36 | 1.68 | 1.51 |

*Relative speed at 1.0 density in LogE
**Relative speed at 2.0 density in LogE

What is claimed is:

1. An aqueous photothermographic composition comprising a) an infrared spectrally sensitized photosensitive silver halide emulsion containing a gelatino peptizer and b) an oxidation-reduction imaging forming composition comprising (i) a dispersion of silver (carboxylate-azine toner) particles wherein the azine content of the particles is from about 0.01 to 10% by weight relative to silver carboxylate said particles having on the surface of the particles a surface modifier which is a nonionic oligomeric surfactant based on a vinyl polymer with an amido function and (ii) an organic reducing agent.

2. The aqueous photothermographic composition according to claim 1 wherein said particles further include carboxylic acid in an amount from about 0.01 to 20% by weight relative to the silver carboxylate.

3. The aqueous photothermograihic composition according to claim 1 wherein said particles are nanoparticulate.

4. The aqueous photothermographic composition according to claim 1 wherein said particles are stabilized by having on their surface a surface modifier that is a nonionic oligomeric surfactant based on vinyl polymers with an amido function.

5. The aqueous photothermographic composition according to claim 1 wherein said silver salt is a salt of a long chain fatty acid containing 8 to 30 carbon atoms.

6. The aqueous photothermographic composition according to claim 1 wherein said silver carboxylate is silver behenate.

7. The aqueous photothermographic composition according to claim 1 wherein said azine toner is phthalazine.

8. A photothermographic element comprising a support having thereon a layer comprising the aqueous photothermographic composition according to claim 1.

* * * * *